US010207303B2

(12) United States Patent
Ueno et al.

(10) Patent No.: US 10,207,303 B2
(45) Date of Patent: Feb. 19, 2019

(54) COLD ROLLING APPARATUS

(71) Applicant: JFE STEEL CORPORATION, Tokyo (JP)

(72) Inventors: Masayasu Ueno, Tokyo (JP); Yoshimitsu Harada, Tokyo (JP); Hidemasa Kodama, Tokyo (JP); Tatsuhito Fukushima, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 295 days.

(21) Appl. No.: 15/112,284

(22) PCT Filed: Jan. 9, 2015

(86) PCT No.: PCT/JP2015/050532
§ 371 (c)(1),
(2) Date: Jul. 18, 2016

(87) PCT Pub. No.: WO2015/107998
PCT Pub. Date: Jul. 23, 2015

(65) Prior Publication Data

US 2016/0332203 A1 Nov. 17, 2016

(30) Foreign Application Priority Data

Jan. 20, 2014 (JP) ..... 2014-008020

(51) Int. Cl.
*B21B 1/22* (2006.01)
*B21B 37/74* (2006.01)
(Continued)

(52) U.S. Cl.
CPC ..... *B21B 1/22* (2013.01); *B21B 37/74* (2013.01); *B21B 45/004* (2013.01); *B21B 2001/221* (2013.01); *B21B 2015/0071* (2013.01)

(58) Field of Classification Search
CPC ..... B21B 2001/221; B21B 2015/0071; B21B 31/185; B21B 37/50; B21B 37/74;
(Continued)

(56) References Cited

U.S. PATENT DOCUMENTS 4,179,913 A * 12/1979 Martt ..... B21B 15/0085 226/21
6,327,883 B1 * 12/2001 Noe ..... B21B 37/32 72/12.2
2007/0193322 A1 * 8/2007 Beck ..... B21B 37/28 72/11.7

FOREIGN PATENT DOCUMENTS

CN 1718298 A 1/2006
CN 201524704 U * 7/2010 ..... B21B 45/06
(Continued)

OTHER PUBLICATIONS

Translation, CN 201524704, Jul. 2010.*
(Continued)

*Primary Examiner* — Edward Tolan
(74) *Attorney, Agent, or Firm* — RatnerPrestia

(57) ABSTRACT

A cold rolling apparatus includes: a heating device configured to heat a sequentially transferred steel sheet; a cold rolling mill configured to sequentially cold-roll the steel sheet after being heated; a meandering-movement correction device arranged on an upstream side of the heating device in a transfer direction of the steel sheet, and configured to correct a meandering movement of the steel sheet transferred toward the heating device; and a meandering-movement suppression device arranged between the heating device and the cold rolling mill, and configured to suppress a meandering movement of the steel sheet attributed to the cold rolling of the steel sheet by using the cold rolling mill.

6 Claims, 4 Drawing Sheets

(51) Int. Cl.
*B21B 45/00* (2006.01)
*B21B 15/00* (2006.01)

(58) Field of Classification Search
CPC ..... B21B 39/082; B21B 39/084; B21B 41/10; B21B 45/004; B21B 1/22
See application file for complete search history.

(56) References Cited

FOREIGN PATENT DOCUMENTS

| | | | | | |
|---|---|---|---|---|---|
| JP | 5370063 | | | 6/1978 | |
| JP | 06115919 | | | 1/1986 | |
| JP | H02303620 | A | | 12/1990 | |
| JP | 03-000409 | A | * | 1/1991 | ..... B21B 39/14 |
| JP | 08187506 | | | 7/1996 | |
| JP | 11172325 | | | 6/1999 | |
| JP | 11290931 | | | 10/1999 | |
| JP | 2000301224 | | | 10/2000 | |
| JP | 2004243376 | A | | 9/2004 | |
| JP | 2005186091 | | | 7/2005 | |
| JP | 2007007754 | | | 1/2007 | |
| JP | 2012148310 | | | 8/2012 | |
| KR | 1019980046764 | | | 9/1998 | |
| KR | 100293190 | B1 | | 4/2001 | |
| KR | 1020020047888 | | | 6/2002 | |
| RU | 2301119 | C1 | | 6/2007 | |
| SU | 737032 | A1 | | 5/1980 | |

OTHER PUBLICATIONS

Russian Office Action for Russian Application No. 2016133723, dated Oct. 25, 2017, including English language translation, 12 pages.
Russian Office Action for Russian Application No. 2016133723, dated Oct. 4, 2017, including English Language translation, 12 pages.
Korean Office Action for Korean Application No. 2016-7019290, dated Dec. 14, 2016, including Concise Statement of Relevance of Office Action, 5 pages.
Chinese Office Action with partial English language transation for Application No. 2015800045823, dated Apr. 18, 2017, 8 pages.
Supplementary European Search Report for Application No. 15736974.5, dated Aug. 17, 2017, 7 pages.
International Search Report and Written Opinion of the International Searching Authority for International Application No. PCT/JP2015/050532 dated Mar. 10, 2015, 5 pages.
Notification of Reason for Refusal of JP2014-008020 dated Jun. 2, 2016, with Concise Statement of Relevance of Office Action, 4 pages.

* cited by examiner

COLD ROLLING APPARATUS

CROSS-REFERENCE TO RELATED APPLICATIONS

This is the U.S. National Phase application of PCT International Application No. PCT/JP2015/050532, filed Jan. 9, 2015, and claims priority to Japanese Patent Application No. JP 2014-008020, filed Jan. 20, 2014, the disclosures of each of these applications being incorporated herein by reference in their entireties for all purposes.

FIELD OF THE INVENTION

The present invention relates to a cold rolling apparatus that cold-rolls a steel sheet.

BACKGROUND OF THE INVENTION

Conventionally, in a cold rolling operation of a steel sheet, regardless of a cold rolling apparatus, such as a completely continuous cold tandem mill, a continuous tandem mill arranged subsequently to a pickling line, or a single-stand reverse mill, the steel sheet heated to a level of room temperature that is at most 40° C. is cold-rolled. This is because, even after considering that the deformation resistance of the steel sheet lowers along with the increase of a steel-sheet temperature, a demerit becomes large compared with a merit obtained by increasing the temperature of the steel sheet that is a material to be rolled. For example, as a merit obtained by increasing the temperature of the steel sheet, the decrease of the rolling power along with the decrease of the deformation resistance of the steel sheet can be designated. However, in the cold rolling operation of the steel sheet, this merit can be almost disregarded. On the other hand, there exists a large demerit attributed to the temperature increases of the steel sheet, such as the extremely large cost loss for increasing a steel-sheet temperature, or the handling problem of a hot steel sheet with respect to a labor environment.

When the steel sheet heated to a level of room temperature is cold-rolled as mentioned above, there exists the possibility that edge cracks occur in an end portion (hereinafter, referred to as "edge portion") in the width direction of the steel sheet in the process of cold rolling. Particularly, a material difficult to be rolled, such as a silicon steel sheet containing 1% or more of silicon, a stainless steel sheet, or a high carbon steel sheet, is a brittle material as compared with a general steel sheet and hence, when the material difficult to be rolled is heated to a level of room temperature and cold-rolled, the edge cracks remarkably occur. When the extent of the edge crack is large, there exists the possibility that the steel sheet is broken from the edge crack as a starting point in the process of cold rolling.

As a method of overcoming such problems, for example, Patent Literature 1 discloses a method for cold-rolling a silicon steel sheet in which the silicon steel sheet at its edge portion heated to 60° C. or higher (ductile brittle transition temperature) is, in cold-rolling the silicon steel sheet, supplied to a rolling mill as a material to be rolled. Furthermore, Patent Literature 2 discloses a pair of induction heating devices each using a C-shaped inductor (heating inductor) as a means for increasing the temperature of an edge portion of a steel sheet by induction heating. The induction heating device described in Patent Literature 2 is constituted such that each of both the edge portions of the steel sheet in the width direction (hereinafter, referred properly to as "sheet width direction") are inserted into a slit of the C-shaped inductor in a vertically sandwiched and spaced apart manner, a high frequency current is sent to the coil of the C-shaped inductor from a power unit to apply magnetic fluxes to the edge portions in the thickness direction of the steel sheet (hereinafter, referred properly to "sheet thickness direction") and generate an induced current in the edge portions, and the edge portions are heated with the Joule heat that occurs by the induced current.

Here, in order to heat the edge portion of the steel sheet to a predetermined temperature, it is necessary that the length of the edge portion of the steel sheet overlapping with the C-shaped inductor whose slit inserts the edge portion thereinto in a vertically sandwiched and spaced apart manner in the sheet thickness direction (hereinafter, referred to as "overlapping length") assume a predetermined value by setting the position of a carriage that supports the C-shaped inductor depending on the sheet width of the steel sheet. However, in an actual operation, a steel sheet moves in a meandering manner in the sheet width direction by a poor centering accuracy or a poor flatness of the steel sheet thus changing the overlapping length. When the overlapping length decreases, the occurrence of an eddy current that obstructs the flow of the magnetic flux decreases and hence, even when a power factor deteriorates to increase a wattless current and a high frequency current that flows into the coil of the C-shaped inductor increases to a rated value, it is impossible to achieve a predetermined output. As a result, there exists the possibility that the underheat of the edge portion occurs. There also exists the possibility that the situation of excessively heating a part of the edge portion (abnormal local heating) arises. In the case of the underheat, edge cracks occur in the edge portion while cold-rolling the steel sheet. The edge cracks cause the fracture of the steel sheet in the process of cold rolling as described above. On the other hand, in the case of the abnormal local heating, edge waves attributed to a deformation by a thermal stress occur in the edge portion of the steel sheet. When the extent of the edge wave is large, there exists the possibility that a drawing fracture occurs in the steel sheet in the process of cold rolling and hence, it is difficult to cold-roll the steel sheet stably. In this manner, when the edge portion of the steel sheet to be cold-rolled is heated to a predetermined temperature by induction heating, it is extremely important to control the overlapping length to an optimal value.

Here, as a conventional technique with respect to the control of the overlapping length mentioned above, for example, there is disclosed an induction heating device provided with a heating coil that heats edge portion of a steel sheet transferred, a coil carriage body on which the heating coil is mounted, a movement mechanism that moves the coil carriage body in the direction orthogonal to the movement direction of the steel sheet, and guide rollers that are attached to the coil carriage body and brought into contact with the edge portion of the steel sheet (refer to Patent Literature 3). The induction heating device described in Patent Literature 3 operates the movement mechanism so that the guide rollers are brought into contact with the edge portion of the steel sheet while induction-heating the steel sheet, and always keeps the relative position relation between the steel sheet and the heating coil constant. On the other hand, there is disclosed a method of induction-heating control in which carriages each of which moves in the direction orthogonal to the movement direction of the steel sheet are located at the respective left-and-right side positions of the line through which the left-and-right edge portions of the steel sheet pass, inductors each of which inserts the edge portion of the steel sheet thereinto in a vertically sandwiched manner are arranged on the respective carriages located at left-and-right positions, and an automatic position controller of the carriage controls the overlapping length between the edge portion of the steel sheet and the inductor to heat the edge portion of the steel sheet (refer to Patent Literature 4). In the method of induction-heating control described in Patent Literature 4, the high frequency current that flows into the heating coil of each of the inductors located at left-and-right positions is detected, the deviation of an electric current value that is generated by the change of the overlapping length due to the meandering movement of the steel sheet is obtained, and a carriage position correction value is obtained based on a relation between a deviation electric current value stored in advance and a carriage position correction amount of the inductor that is required to set the deviation electric current value to zero. Subsequently, the carriage position correction value is subtracted from a carriage position initialized value on the large electric current value side of the carriage and, at the same time, the carriage position correction value is added to a carriage position initialized value on the small electric current value side of the carriage to obtain a carriage correction position on either side. Thereafter, the carriage correction position on the either side that is calculated as mentioned above is output to the automatic position controller of each carriage on either side and hence, the position of each carriage on the either side is corrected by the automatic position controller. Due to such a constitution, the overlapping length between each of the left-and-right edge portions of the steel sheet and each inductor on either side is controlled.

CITATION LIST

Patent Literature

Patent Literature 1: Japanese Laid-open Patent Publication No. 61-15919

Patent Literature 2: Japanese Laid-open Patent Publication No. 11-290931

Patent Literature 3: Japanese Laid-open Patent Publication No. 53-70063

Patent Literature 4: Japanese Laid-open Patent Publication No. 11-172325

SUMMARY OF THE INVENTION

In the conventional techniques mentioned above, the overlapping length between the edge portion of the steel sheet and the inductor of the induction heating device is corrected depending on a position change of the edge portion that is attributed to the meandering movement of the steel sheet. That is, a feedback control that corrects the overlapping length depending on the position change of the edge portion is conventionally performed. However, a meandering movement speed of the steel sheet is comparatively higher than the travelling speed of the carriage that mounts the inductor thereon and hence, in the conventional techniques mentioned above, it is difficult to adapt sufficiently the feedback control of the overlapping length to the position change of the edge portion that is attributed to the meandering movement of the steel sheet. Accordingly, in heating the edge portion of the steel sheet before being cold-rolled to a predetermined temperature by induction heating, it is extremely difficult to control stably the overlapping length to an optimal value. As a result, in the steel sheet as a material to be rolled, the underheat or abnormal local heating of the edge portion occurs. When the steel sheet is cold-rolled in this state, the fracture of the steel sheet occurs due to the edge cracks generated by the underheat of the edge portion, or the drawing fracture of the steel sheet occurs due to the edge wave generated by the abnormal local heating of the edge portion. The occurrence of the fracture attributed to the edge cracks of the steel sheet or the drawing fracture attributed to the edge wave (hereinafter, referred collectively to as "steel-sheet fracture", as needed) inhibits the cold rolling operation of the steel sheet and results in lower cold rolling production efficiency.

The present invention has been made under such circumstances, and it is an object of the present invention to provide a cold rolling apparatus that is capable of suppressing the occurrence of a steel-sheet fracture as much as possible to achieve stable cold rolling of a steel sheet.

To solve the above-described problem and achieve the object, a cold rolling apparatus according to embodiments of the present invention heats a sequentially transferred steel sheet by using a heating device, and sequentially cold-rolls the steel sheet after being heated by using a cold rolling mill, and includes: a meandering-movement correction device arranged on an upstream side of the heating device in a transfer direction of the steel sheet, and configured to correct a meandering movement of the steel sheet transferred toward the heating device; and a meandering-movement suppression device arranged between the heating device and the cold rolling mill, and configured to suppress a meandering movement of the steel sheet attributed to the cold rolling of the steel sheet by using the cold rolling mill.

Moreover, in the cold rolling apparatus according to an embodiment of the present invention, the meandering-movement correction device includes: roll bodies configured to rotate while being brought into contact with the steel sheet so as to transfer the steel sheet; and a roll tilting unit configured to tilt the roll bodies so that a center axis of each of the roll bodies tilts with respect to a horizontal direction, and the meandering-movement suppression device includes a plurality of roll bodies arranged zigzag in the transfer direction of the steel sheet and configured to transfer the steel sheet toward an entrance side of the cold rolling mill from an exit side of the heating device and to sandwich the steel sheet from both sides of the steel sheet in a thickness direction so as to restrain the movement thereof in a width direction.

Moreover, in the cold rolling apparatus according to an embodiment of the present invention, the roll bodies in the meandering-movement correction device are bridle rolls configured to control a tensile force of the steel sheet.

Moreover, in the cold rolling apparatus according to an embodiment of the present invention, the heating device includes C-shaped inductors into which respective edge portions of the steel sheet in a width direction are inserted in a sandwiched and spaced apart manner in a thickness direction of the steel sheet, and the heating device heats both of the edge portions of the steel sheet by an induction heating system.

According to the present invention, it is possible to achieve advantageous effects that suppress the occurrence of a steel-sheet fracture as much as possible, and enable stable cold rolling of a steel sheet.

DETAILED DESCRIPTION OF EMBODIMENTS OF THE INVENTION

Hereinafter, the explanation is, in reference to attached drawings, specifically made with respect to a preferred embodiment of a cold rolling apparatus according to the present invention. Here, the present invention is not limited to the present embodiment.

Embodiment

Figure 1:
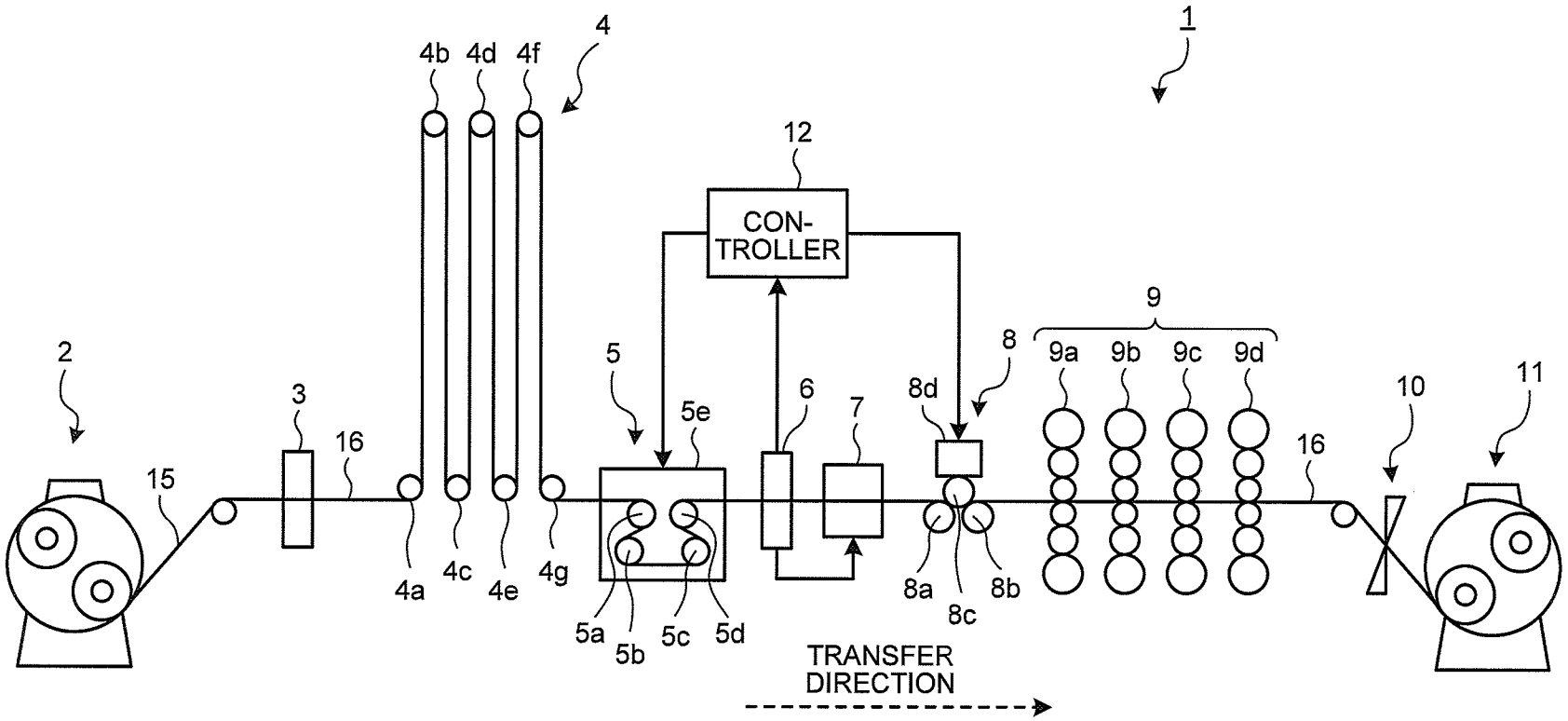
FIG. 1 is a view illustrating one configuration example of a cold rolling apparatus according to an embodiment of the present invention.

First of all, the cold rolling apparatus according to the embodiment of the present invention is explained. FIG. 1 is a view illustrating one configuration example of the cold rolling apparatus according to the embodiment of the present invention. As illustrated in FIG. 1, a cold rolling apparatus 1 according to the present embodiment is provided with an uncoiler 2 and a tension reel 11 that are arranged on an entrance end and an exit end of a transfer passage for a material to be rolled, respectively. Furthermore, the cold rolling apparatus 1 is provided with a welding machine 3, a looper 4, a meandering-movement correction device 5, a sheet width meter 6, a heating device 7, a meandering-movement suppression device 8, a cold rolling mill 9, and a flying shear 10 along the transfer passage of the material to be rolled between the uncoiler 2 and the tension reel 11. Furthermore, the cold rolling apparatus 1 is provided with a controller 12 that controls the meandering-movement correction device 5 and the meandering-movement suppression device 8.

The uncoiler 2 takes steel sheets 15 from a coil formed by winding steel materials, such as hot rolled steel sheets, by uncoiling the coil to supply the steel sheets 15 sequentially to the transfer passage of a material to be rolled in the cold rolling apparatus 1. The steel sheets 15 taken from the uncoiler 2 pass through a pinch roll or the like to be transferred sequentially to the welding machine 3 located on the downstream side of the uncoiler 2 in the transfer direction of the steel sheets 15.

The welding machine 3 is constituted of a laser beam welding machine or the like and, as illustrated in FIG. 1, arranged between the uncoiler 2 and the looper 4 in the vicinity of the transfer passage of the material to be rolled. The welding machine 3 receives sequentially the plurality of steel sheets 15 supplied from the uncoiler 2, and welds the tail end portion of the steel sheet preceding in the transfer direction out of the steel sheets 15 (hereinafter, referred to as "preceding material") and the distal end portion of the steel sheet succeeding the precedent material (hereinafter, referred to as "succeeding material"). The welding machine 3 performs sequentially welding processing with respect to the steel sheets 15 supplied from the uncoiler 2; that is, the welding machine 3 welds sequentially the tail end portion of the preceding material and the distal end portion of the succeeding material as mentioned above thus forming a steel strip 16 produced by joining the distal end portion and the tail end portion of the respective steel sheets 15. The steel strip 16 is taken out from the welding machine 3 and thereafter, transferred sequentially to the looper 4 located on the downstream side of the welding machine 3 in the transfer direction of the steel strip 16.

The looper 4 is a device for accumulating or supplying properly the steel strip 16 to which continuous processing, such as cold rolling, is applied. To be more specific, as illustrated in FIG. 1, the looper 4 is provided with a plurality of fixed rolls 4*a*, 4*c*, 4*e*, and 4*g* and a plurality of movable rolls 4*b*, 4*d*, and 4*f* movable in the direction toward or away from the fixed rolls 4*a*, 4*c*, 4*e*, and 4*g*. In such a looper 4, as illustrated in FIG. 1, the fixed roll 4*a*, the movable roll 4*b*, the fixed roll 4*c*, the movable roll 4*d*, the fixed roll 4*e*, the movable roll 4*f*, and the fixed roll 4*g* are arranged along the transfer passage of the steel strip 16 in the order given above.

The fixed rolls 4*a*, 4*c*, 4*e*, and 4*g* each of which is a transfer roll located at a fixed position are, as illustrated in FIG. 1 for example, arranged so as to be aligned in the direction toward the meandering-movement correction device 5 from the welding machine 3. The fixed rolls 4*a*, 4*c*, 4*e*, and 4*g* are brought into contact with the steel strip 16 extended therealong and wrapped therearound. In this state, each fixed roll rotates about the roll center axis thereof as a center by the operation of a drive unit (not illustrated in the drawings). Accordingly, each of the fixed rolls 4*a*, 4*c*, 4*e*, and 4*g* transfers the steel strip 16 along the transfer passage of the steel strip 16 and, at the same time, applies a tensile force to the steel strip 16 at a fixed position. On the other hand, each of the movable rolls 4*b*, 4*d*, and 4*f* is a transfer roll movable in the direction toward or away from the fixed rolls 4*a*, 4*c*, 4*e*, and 4*g* by the operation of the movement mechanism (not illustrated in the drawings) such as a loop car. The movable rolls 4*b*, 4*d*, and 4*f* are brought into contact with the steel strip 16 extended therealong and wrapped therearound. In this state, each movable roll rotates about the roll center axis thereof as a center. Accordingly, the movable rolls 4*b*, 4*d*, and 4*f* stretch the steel strip 16 in cooperation with the fixed rolls 4*a*, 4*c*, 4*e*, and 4*g* and, at the same time, transfer the steel strip 16 in the transfer direction of the steel strip 16.

The looper 4 having the constitution mentioned above is, as illustrated in FIG. 1, arranged on the upstream side of the cold rolling mill 9 in the transfer direction of the steel strip 16, and to be more specific, arranged between the welding machine 3 and the meandering-movement correction device 5 to accumulate or supply the steel strip 16. Accordingly, a staying time of the steel strip 16 in the looper 4 is adjusted. The operation of accumulating or supplying the steel strip 16 by the looper 4 is performed for absorbing a transfer idle time or the like of the steel strip 16 that occurs in performing steel-sheet welding by the welding machine 3 or in shearing the steel strip 16 by the flying shear 10. For example, in the cold rolling apparatus 1, in a period of time that elapses while the welding machine 3 does not weld the steel strip 16, the looper 4 receives the steel strip 16 from the welding machine 3 while moving the movable rolls 4*b*, 4*d*, and 4*f* in the direction away from the fixed rolls 4*a*, 4*c*, 4*e*, and 4*g*. Accordingly, the looper 4 accumulates the steel strip 16 supplied from the welding machine 3 while transferring the steel strip 16 continuously to the cold rolling mill 9 side of the transfer passage. On the other hand, in a period of time that elapses while the welding machine 3 welds the distal end portion and the tail end portion of the respective steel sheets 15, the transfer of the steel strip 16 from the welding machine 3 to the looper 4 is stopped. In this case, the looper 4 moves the movable rolls 4*b*, 4*d*, and 4*f* in the direction toward the fixed rolls 4*a*, 4*c*, 4*e*, and 4*g*. Accordingly, the looper 4 supplied the steel strip 16 being accumulated as described above to the cold rolling mill 9 side of the transfer passage, and maintains the continuous transferring of the steel strip 16 from the welding-machine-3 side to the cold rolling mill 9 side in the transfer passage. The looper 4 moves again, after the completion of welding the steel strip 16 by the welding machine 3, the movable rolls 4*b*, 4*d*, and 4*f* in the direction away from the fixed rolls 4*a*, 4*c*, 4*e*, and 4*g*. The looper 4 accumulates the steel strip 16 received from the welding machine 3 in this state while transferring the steel strip 16 continuously to the cold rolling mill 9 side of the transfer passage. In this manner, the looper 4 maintains the continuous transferring of the steel strip 16 from the welding-machine-3 side to the cold rolling mill 9 side in the transfer passage. The steel strip 16 supplied from the looper 4 is transferred sequentially to the meandering-movement correction device 5 located on the downstream side of the looper 4 in the transfer direction of the steel strip 16.

The meandering-movement correction device 5 is, as illustrated in FIG. 1, arranged on the upstream side of the heating device 7 in the transfer direction of the steel strip 16, and corrects the meandering movement of the steel strip 16 to be transferred toward the heating device 7. In the present embodiment, the meandering-movement correction device 5 is provided with four bridle rolls 5*a* to 5*d*, and a roll tilting unit 5*e* that tilts the bridle rolls 5*a* to 5*d*.

Each of the bridle rolls 5*a* to 5*d* has a function as a roll body that transfers the steel strip 16, and a function as a roll body for controlling a tensile force applied to the steel strip 16. To be more specific, each of the bridle rolls 5*a* to 5*d* is arranged along the transfer passage of the steel strip 16 so that a wrapping angle of the steel strip 16 is equal to or larger than a predetermined value (90 degrees or larger, for example). Here, the wrapping angle is a central angle of each of the bridle rolls 5*a* to 5*d*, the central angle corresponding to a peripheral surface part of each bridle roll, the peripheral surface part being brought into contact with the steel strip 16. Each of the bridle rolls 5*a* to 5*d* arranged in this manner rotates, while being brought into contact with the steel strip 16 extended along and wrapped around the bridle rolls 5*a* to 5*d*, about the roll center axis thereof as a center by the operation of a drive unit (not illustrated in the drawings). Accordingly, the bridle rolls 5*a* to 5*d* transfer, while applying a tensile force to the steel strip 16 by the friction force generated between the peripheral surface of each bridle roll and the steel strip 16, the steel strip 16 from the looper-4 side to the heating-device-7 side in the transfer passage. In this case, the bridle roll 5*a* stretches the steel strip 16 in cooperation with the bridle roll 5*b* and, at the same time, transfers the steel strip 16 from the looper-4 side to the bridle-roll-5*b* side in the transfer passage. The bridle roll 5*b* stretches the steel strip 16 in cooperation with the bridle rolls 5*a* and 5*c* and, at the same time, transfers the steel strip 16 from the bridle-roll-5*a* side to the bridle-roll-5*c* side in the transfer passage. The bridle roll 5*c* stretches the steel strip 16 in cooperation with the bridle rolls 5*b* and 5*d* and, at the same time, transfers the steel strip 16 from the bridle-roll-5*b* side to the bridle-roll-5*d* side in the transfer passage. The bridle roll 5*d* stretches the steel strip 16 in cooperation with the bridle roll 5*c* and, at the same time, transfers the steel strip 16 from the bridle-roll-5*c* side to the heating-device-7 side in the transfer passage. As described above, the tensile force applied to the steel strip 16 by the bridle rolls 5*a* to 5*d* is controlled by adjusting a rotational speed of each of the bridle rolls 5*a* to 5*d*.

Figure 2:
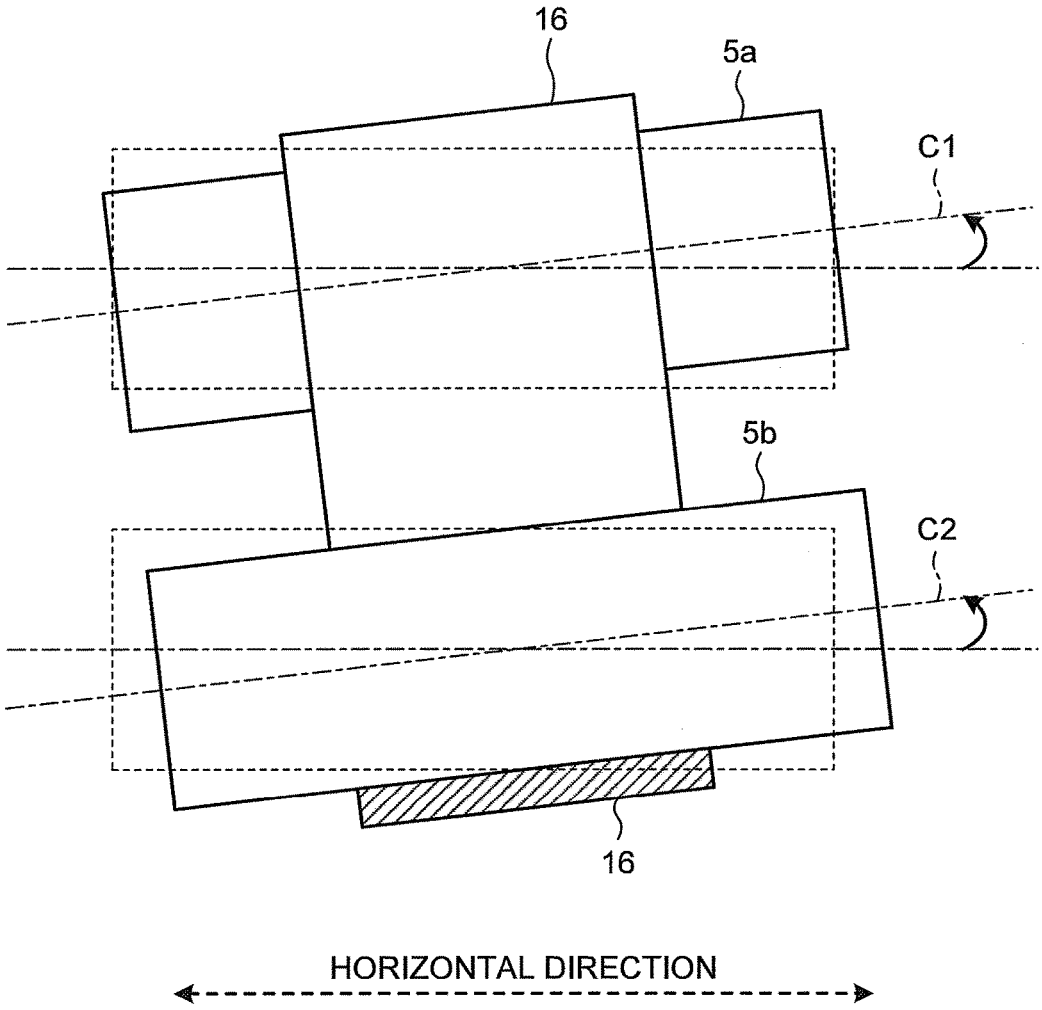
FIG. 2 is a view illustrating a state of tilting bridle rolls of a meandering-movement correction device in the present embodiment.

Furthermore, the bridle rolls 5*a* to 5*d* have a steering function capable of correcting the meandering movement of the steel strip 16. To be more specific, the bridle rolls 5*a* to 5*d* are supported by the roll tilting unit 5*e* in a state that each of the bridle rolls 5*a* to 5*d* is capable of rotating about the roll center axis thereof as a center of rotation. The roll tilting unit 5*e* tilts the bridle rolls 5*a* to 5*d* so that the roll center axis of each of the bridle rolls 5*a* to 5*d* tilts with respect to the horizontal direction. FIG. 2 is a view illustrating a state of tilting the bridle rolls of the meandering-movement correction device in the present embodiment. The roll tilting unit 5*e* tilts, when the meandering-movement of the steel strip 16 occurs, the bridle rolls 5*a* and 5*b* so that as illustrated in FIG. 2 for example, roll center axes C1 and C2 of the respective bridle rolls 5*a* and 5*b* that stretch the steel strip 16 tilt with respect to the horizontal direction. In the present embodiment, the roll tilting unit 5*e* also tilts the bridle rolls 5*c* and 5*d* as well as the above-mentioned bridle rolls 5*a* and 5*b*. The bridle rolls 5*a* to 5*d* are constituted in a downwardly tilting manner in the direction opposite to the meandering-movement direction of the steel strip 16 by such a tilting operation that is the steering function of the roll tilting unit 5*e* thus correcting the meandering movement of the steel strip 16.

The steel strip 16 transferred from the above-mentioned meandering-movement correction device 5 is sequentially transferred to the heating device 7 positioned on the upstream side of the meandering-movement suppression device 8 in the transfer direction of the steel strip 16 through the sheet width meter 6 arranged on the exit side of the meandering-movement correction device 5.

The sheet width meter 6 is, as illustrated in FIG. 1, arranged between the meandering-movement correction device 5 and the heating device 7, and measures a meandering-movement amount and a sheet width of the steel strip 16 the meandering movement of which has been corrected by the meandering-movement correction device 5. At this point, the sheet width meter 6 detects both of the edge portions of the steel strip 16 the meandering movement of which has been corrected, and calculates the respective detected positions of both of the edge portions. Next, the sheet width meter 6 calculates the center position of the steel strip 16 in the sheet width direction based on the respective calculated positions of both of the edge portions, and calculates the difference between the center position and the center of the transfer passage of the steel strip 16 as a meandering-movement amount of the steel strip 16. Furthermore, the sheet width meter 6 calculates a sheet width of the steel strip 16 based on the respective obtained positions of both of the edge portions. The sheet width meter 6 performs, continuously or intermittently for each predetermined time, such calculation (measurement) of a meandering-movement amount and a sheet width of the steel strip 16 the meandering movement of which has been corrected. In each case, the sheet width meter 6 transmits the obtained meandering-movement amount and sheet width of the steel strip 16 to the controller 12 and the heating device 7, respectively.

Figure 3:
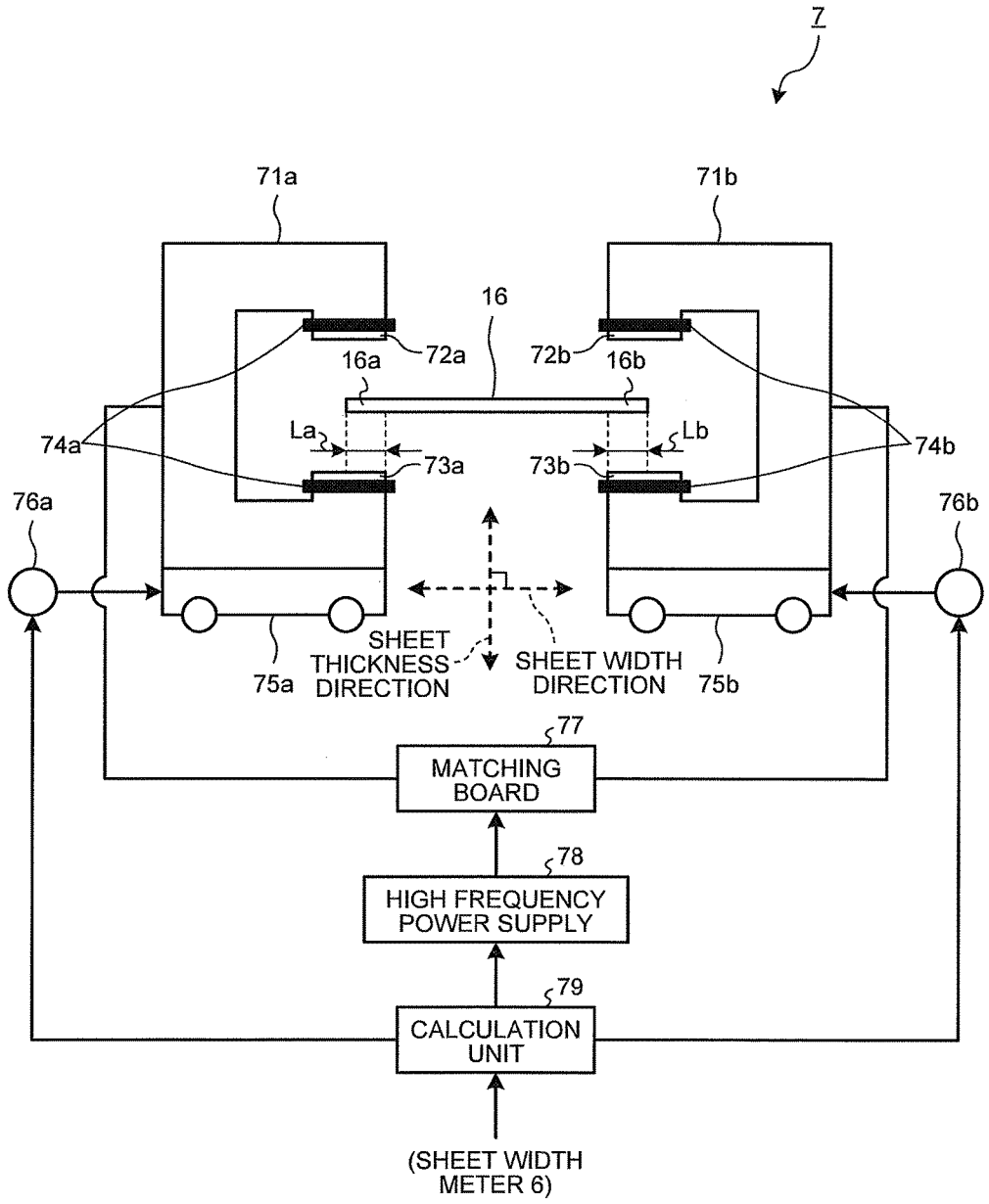
FIG. 3 is a view illustrating one configuration example of a heating device of the cold rolling apparatus in the present embodiment.

The heating device 7 heats the steel strip 16 transferred sequentially before the steel strip 16 is cold-rolled. In the present embodiment, the heating device 7 is, as illustrated in FIG. 1, arranged on the upstream side of the cold rolling mill 9 in the transfer direction of the steel strip 16. To be more specific, the heating device 7 is arranged between the meandering-movement correction device 5 and the meandering-movement suppression device 8, and heats (induction-heats) both the edge portions of the steel strips 16 by an induction heating system. FIG. 3 is a view illustrating one configuration example of the heating device of the cold rolling apparatus in the present embodiment. As illustrated in FIG. 3, the heating device 7 is provided with a pair of C-shaped inductors 71*a* and 71*b* each of which is constituted so that each of edge portions 16*a* and 16*b* in the sheet width direction of the steel strip 16 is inserted into each of the C-shaped inductors 71*a* and 71*b* in a sandwiched and spaced apart manner in the sheet thickness direction (vertically, for example) of the steel strip 16. Each of leg portions 72*a* and 73*a* of the inductor 71*a* includes heating coils 74*a*. The heating coils 74*a* apply, when the edge portion 16*a* of the steel strip 16 passes through the inside of the space between the leg portions 72*a* and 73*a* of the inductor 71*a*, magnetic fluxes to the edge portion 16*a* in the sheet thickness direction to induction-heat the edge portion 16*a*. On the other hand, each of leg portions 72*b* and 73*b* of the inductor 71*b* includes heating coils 74*b*. The heating coils 74*b* apply, when the edge portion 16*b* of the steel strip 16 passes through the inside of the space between the leg portions 72*b* and 73*b* of the inductor 71*b*, magnetic fluxes to the edge portion 16*b* in the sheet thickness direction to induction-heat the edge portion 16*b*. Furthermore, the heating device 7 is, as illustrated in FIG. 3, provided with a matching board 77, a high frequency power supply 78, and a calculation unit 79. The heating coils 74*a* and 74*b* are connected to the high frequency power supply 78 via the matching board 77. The calculation unit 79 is connected to the high frequency power supply 78. The calculation unit 79 sets heating conditions of the steel strip 16 based on a thickness, a transfer speed, and a steel grade of the steel strip 16, and instructs the high frequency power supply 78 to output a high frequency current to be sent to the heating coils 74*a* and 74*b* depending on the set heating conditions. The high frequency power supply 78 sends the high frequency current to the heating coils 74*a* and 74*b* via the matching board 77 based on an output instruction from the calculation unit 79 and hence, each of the heating coils 74*a* and 74*b* generates a magnetic flux (high frequency magnetic flux) in the sheet thickness direction. The high frequency magnetic flux generates an induction current in each of the edge portions 16*a* and 16*b* of the steel strip 16, and the induction current generates Joule heat in each of the edge portions 16*a* and 16*b*. Both of the edge portions 16*a* and 16*b* are induction-heated by the Joule heat generated thus being heated to the temperature higher than a ductile brittle transition temperature.

Furthermore, the heating device 7 is, as illustrated in FIG. 3, provided with carriages 75*a* and 75*b* that move the inductors 71*a* and 71*b* in the sheet width direction of the steel strip 16 respectively, and position controllers 76*a* and 76*b* that control the positions of the inductors 71*a* and 71*b* respectively. The inductor 71*a* is arranged on the carriage 75*a*, and the inductor 71*b* is arranged on the carriage 75*b*. The carriages 75*a* and 75*b* are moved in the sheet width direction of the steel strip 16 thus moving the inductors 71*a* and 71*b* in the sheet width direction of the steel strip 16 respectively. Each of the position controllers 76*a* and 76*b* connects, as illustrated in FIG. 3, the calculation unit 79 thereto. The calculation unit 79 receives the sheet width of the steel strip 16 from the sheet width meter 6 mentioned above, and calculates respective target positions of the inductors 71*a* and 71*b* (specifically, respective target positions of the heating coils 74*a* and 74*b*) in the sheet width direction of the steel strip 16 depending on the sheet width received. The calculation unit 79 transmits respectively the calculated target positions of the inductors 71*a* and 71*b* to the position controllers 76*a* and 76*b*. The position controllers 76*a* and 76*b* perform drive control of the respective carriages 75*a* and 75*b* based on the target positions of the respective inductors 71*a* and 71*b* that are received from the calculation unit 79, and control the positions of the respective inductors 71*a* and 71*b* via the drive control of the respective carriages 75*a* and 75*b*. In other words, the position controller 76*a* controls the movement of the carriage 75*a* in the sheet width direction of the steel strip 16 so that the position of the inductor 71*a* and the target position corresponding to the sheet width of the steel strip 16 coincide with each other, and controls the position of the inductor 71*a* to the target position via the control of the carriage 75*a*. At the same time, the position controller 76*b* controls the movement of the carriage 75*b* in the sheet width direction of the steel strip 16 so that the position of the inductor 71*b* and the target position corresponding to the sheet width of the steel strip 16 coincide with each other, and controls the position of the inductor 71*b* to the target position via the control of the carriage 75*b*. As a result, each of the overlapping lengths La and Lb of both of the edge portions 16*a* and 16*b* of the steel strip 16 with the respective inductors 71*a* and 71*b* (refer to FIG. 3) is stationarily controlled irrespective of the change of the sheet width of the steel strip 16. In this manner, each of the overlapping lengths La and Lb being stationarily controlled assumes an optimal value for heating the edge portions 16*a* and 16*b* of the steel strip 16 to a temperature equal to or higher than the ductile brittle transition temperature.

In the present embodiment, as illustrated in FIG. 3, the overlapping length La of the edge portion 16*a* of the steel strip 16 with the inductor 71*a* is a length of overlapping the edge portion 16*a* vertically sandwiched between the leg portions 72*a* and 73*a* of the inductor 71*a* in the sheet thickness direction in a spaced apart manner with the inductor 71*a* (to be more specific, the leg portions 72*a* and 73*a*). The overlapping length Lb of the edge portion 16*b* of the steel strip 16 with the inductor 71*b* is a length of overlapping the edge portion 16*b* vertically sandwiched between the leg portions 72*b* and 73*b* of the inductor 71*b* in the sheet thickness direction in a spaced apart manner with the inductor 71*b* (to be more specific, the leg portions 72*b* and 73*b*).

The meandering-movement suppression device 8 is, as illustrated in FIG. 1, arranged between the heating device 7 and the cold rolling mill 9, and suppresses a meandering movement of the steel strip 16 attributed to the cold rolling of the steel strip 16 by the cold rolling mill. In the embodiment, the meandering-movement suppression device 8 includes an entrance side roll 8*a*, an exit side roll 8*b*, and a central roll 8*c* as a plurality of roll bodies that transfer the steel strip 16 and suppress a meandering movement of the steel strip 16. The meandering-movement suppression device 8 further includes a roll movement unit 8*d* that moves the central roll 8*c*.

The entrance side roll 8*a*, the exit side roll 8*b*, and the central roll 8*c* are, as illustrated in FIG. 1, arranged zigzag in the transfer direction of the steel strip 16, sandwiching the steel strip 16 from both sides (the top and the bottom) of the steel strip 16 in the sheet thickness direction. In other words, the entrance side roll 8*a* and the exit side roll 8*b* are arranged on a lower side in the sheet thickness direction of the steel strip 16 so that the entrance side roll 8*a* and the exit side roll 8*b* are aligned in the transfer direction of the steel strip 16 in this order. The central roll 8*c* is arranged on an upper side in the sheet thickness direction of the steel strip 16 so that the peripheral surface of the central roll 8*c* faces a space between the entrance side roll 8*a* and the exit side roll 8*b*.

While being brought into contact with the steel strip 16, each of the entrance side roll 8*a*, the exit side roll 8*b*, and the central roll 8*c* that are arranged zigzag in this manner rotates about the roll center axis thereof as a center by the operation of a drive unit (not illustrated in the drawings). Accordingly, each of the entrance side roll 8*a*, the exit side roll 8*b*, and the central roll 8*c* sequentially transfers the steel strip 16 toward the entrance side of the cold rolling mill 9 from the exit side of the heating device 7.

Figure 4:
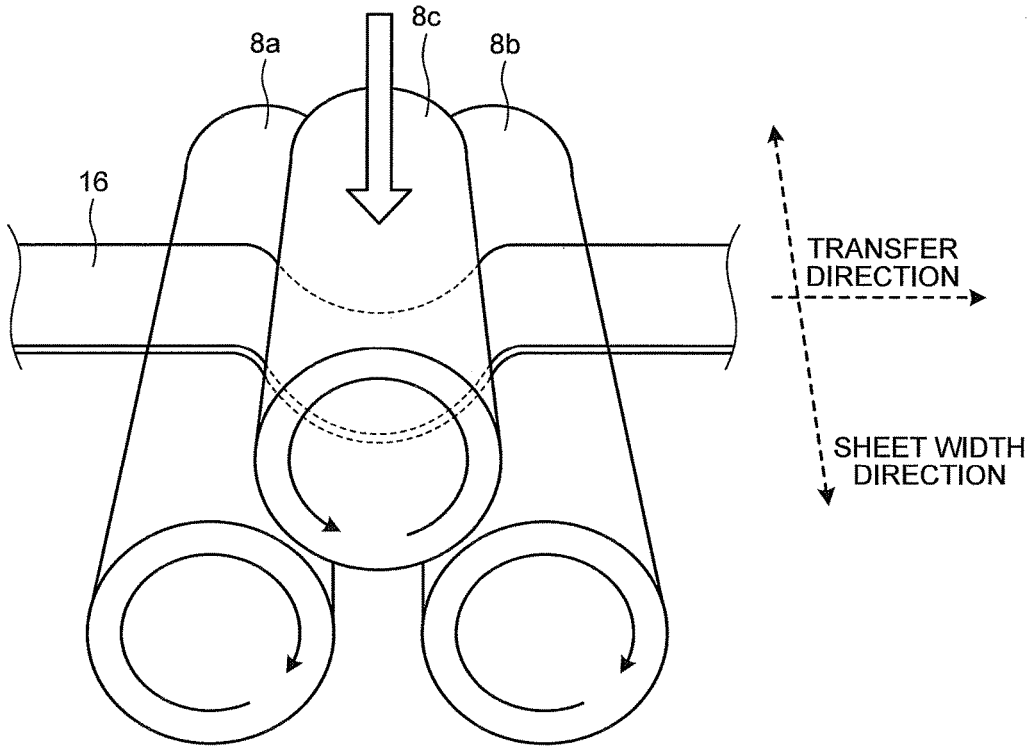
FIG. 4 is a view illustrating a state of restraining movement of a steel strip in the sheet width direction by roll bodies of a meandering-movement suppression device in the present embodiment.

The entrance side roll 8*a*, the exit side roll 8*b*, and the central roll 8*c* sandwich the steel strip 16 from both sides of the steel strip 16 in the sheet thickness direction by the operation of the roll movement unit 8*d* so as to restrain the movement of the steel strip 16 in the sheet width direction. FIG. 4 is a view illustrating a state of restraining the movement of the steel strip 16 in the sheet width direction by the roll bodies of the meandering-movement suppression device in the present embodiment. The roll movement unit 8*d* rotatably and pivotally supports the central roll 8*c* and moves the central roll 8*c* in the sheet thickness direction (lower side) of the steel strip 16. In this manner, the roll movement unit 8*d* presses the central roll 8*c* toward the entrance side roll 8*a* and the exit side roll 8*b*. By the operation of the roll movement unit 8*d*, the central roll 8*c* presses, as illustrated in FIG. 4, the steel strip 16 that is being transferred by the operation of the entrance side roll 8*a* and the exit side roll 8*b* from the upper side in the sheet thickness direction toward the entrance side roll 8*a* and the exit side roll 8*b*. As described above, the entrance side roll 8*a*, the exit side roll 8*b*, and the central roll 8*c* transfer the steel strip 16, and sandwich the steel strip 16 from both sides of the steel strip 16 in the sheet thickness direction so as to restrain the movement of the steel strip 16 in the sheet width direction while maintaining the transferring of the steel strip 16. As a result, the entrance side roll 8*a*, the exit side roll 8*b*, and the central roll 8*c* suppress a meandering movement of the steel strip 16 that occurs due to the cold rolling of the steel strip 16 by the cold rolling mill 9.

On the other hand, the above-mentioned roll movement unit 8*d* moves the central roll 8*c* in the sheet thickness direction (upper side) of the steel strip 16 as needed so as to move the central roll 8*c* in the direction away from the entrance side roll 8*a* and the exit side roll 8*b*. As a result, the central roll 8*c* can release a state of restraining the movement of the steel strip 16 in the sheet width direction (refer to FIG. 4) as appropriate.

The cold rolling mill 9 is a tandem rolling mill that continuously cold-rolls the sequentially transferred steel strip 16, and is constituted of a plurality of rolling mills installed next to each other in the transfer direction of the steel strip 16. In the present embodiment, the cold rolling mill 9 is, as illustrated in FIG. 1, constituted of four rolling mills 9*a* to 9*d*, and is arranged on the downstream side of the heating device 7 in the transfer direction of the steel strip 16. To be more specific, the cold rolling mill 9 is arranged between the meandering-movement suppression device 8 and the flying shear 10. The four rolling mills 9*a* to 9*d* that constitute the cold rolling mill 9 are installed next to each other in the transfer direction of the steel strip 16 in this order. The steel strip 16 after being heated by the heating device 7 is transferred to the entrance side of the cold rolling mill 9 from the exit side of the heating device 7 through the meandering-movement suppression device 8. While the movement of the steel strip 16 in the sheet width direction is restrained by the meandering-movement suppression device 8 as described above, the steel strip 16 is transferred to the rolling mill 9*a* located on the uppermost stream side of the cold rolling mill 9. The cold rolling mill 9 causes the rolling mills 9*a* to 9*d* to continuously cold-roll the steel strip 16 in this state so as to define the sheet thickness of the steel strip 16 as a predetermined target sheet thickness. The steel strip 16 after being cold-rolled by the cold rolling mill 9 is transferred to the exit side of the rolling mill 9*d* located on the lowermost stream side, and is sequentially transferred to the flying shear 10 through a pinch roll or the like.

The flying shear 10 is, as illustrated in FIG. 1, arranged between the exit side of the cold rolling mill 9 and the tension reel 11, and cuts the steel strip 16 after being cold-rolled by the cold rolling mill 9 to a predetermined length. The tension reel 11 winds the steel strip 16 cut by the flying shear 10 in a coiled shape.

The controller 12 controls a meandering-movement correction operation of the steel strip 16 performed by the meandering-movement correction device 5, and a meandering-movement suppression operation of the steel strip 16 performed by the meandering-movement suppression device 8. To be more specific, the controller 12 controls operations of the roll tilting unit 5*e* of the meandering-movement correction device 5 based on a meandering-movement amount of the steel strip 16 that is obtained by the sheet width meter 6, and controls a tilting angle and a tilting direction of the bridle rolls 5*a* to 5*d* in the meandering-movement correction device 5 with respect to the horizontal direction via the control of the roll tilting unit 5*e*. In this manner, the controller 12 causes the meandering-movement correction device 5 to correct (modify) a meandering-movement amount of the steel strip 16 so that a meandering-movement amount of the steel strip 16 before being transferred to the heating device 7 corresponds to a value within an allowable range. The allowable range of the meandering-movement amount is a range of the meandering-movement amount of the steel strip 16 in which each of the overlapping lengths La and Lb between the inductors 71*a* and 71*b* of the heating device 7 and the respective edge portions 16*a* and 16*b* of the steel strip 16 illustrated in FIG. 3 is capable of being controlled stationarily, and the meandering-movement amount of the steel strip 16 is, for example, a zero value or a value approximated to the zero value. In addition to the above-mentioned control, the controller 12 controls the roll movement unit 8*d* to press the central roll 8*c* toward the entrance side roll 8*a* and the exit side roll 8*b* in the meandering-movement suppression device 8 at a timing when the controller 12 causes the bridle rolls 5*a* to 5*d* in the meandering-movement correction device 5 to be tilted. In this manner, the controller 12 allows the entrance side roll 8*a*, the exit side roll 8*b*, and the central roll 8*c* in the meandering-movement suppression device 8 to restrain the movement of the steel strip 16 in the sheet width direction at a timing when the meandering-movement correction device 5 performs a meandering-movement correction operation of the steel strip 16. As a result, the controller 12 can exhibit an operation in which the meandering-movement correction device 5 corrects a meandering movement of the steel strip 16 that occurs at the time of transferring the steel strip 16 toward the heating device 7 (hereinafter, referred to as "meandering-movement correction operation"), and an operation in which the meandering-movement suppression device 8 suppresses a meandering movement of the steel strip 16 that is attributed to the cold rolling of the steel strip 16 by the cold rolling mill 9 (hereinafter, referred to as "meandering-movement suppression operation") at the same time. Because of a synergetic effect of these meandering-movement correction operation and meandering-movement suppression operation, a state of correcting a meandering movement of the steel strip 16 by the meandering-movement correction device 5 can be maintained in the period of heating the steel strip 16 by the heating device 7. On the other hand, the controller 12 controls a rotational speed of each of the bridle rolls 5*a* to 5*d* in the meandering-movement correction device 5 thus controlling a tensile force of the steel strip 16 through the bridle rolls 5*a* to 5*d*.

Here, the steel strip 16 is a strip-shaped steel sheet formed by joining the tail end portion of a preceding material and the distal end portion of a succeeding material in the plurality of steel sheets 15 transferred sequentially, and one example of a steel sheet as a material to be rolled in the present embodiment. Furthermore, as each steel sheet 15 that constitutes the steel strip 16, a material difficult to be rolled such as a silicon steel sheet containing 1% or more of silicon, a stainless steel sheet, or a high carbon steel sheet is used.

The steel strip 16 to be cold-rolled generally includes defects in shape such as center buckle or uneven elongation that are formed in a hot-rolled coil (hot rolled sheet steel) serving as a base material of the steel strip 16 when hot-rolling. Accordingly, in the cold rolling apparatus 1, when the steel strip 16 is sequentially transferred toward the heating device 7, the meandering movement occurs in the steel strip 16 being transferred, by the bending moment that acts due to the tension distribution in the sheet width direction occurring depending on the shape of the steel strip 16. Assuming that the meandering-movement correction device 5 is not arranged at the preceding stage of the heating device 7, the meandering movement depending on the shape of a base material occurs occasionally in the steel strip 16 on the entrance side of the heating device 7. Particularly, in the joint portion between respective steel sheets that constitute the steel strip 16, a rapid meandering movement occurs in the steel strip 16. In this manner, when the meandering movement occurs in the steel strip 16, it is difficult to induction-heat uniformly the edge portions 16*a* and 16*b* of the steel strip 16 by the heating device 7. Due to such circumstances, the underheat or the abnormal local heating of the edge portions 16*a* and 16*b* of the steel strip 16 occurs and, as a result, a steel-sheet fracture occurs while cold-rolling the steel strip 16.

On the other hand, the cold rolling apparatus 1 according to the present embodiment is, as illustrated in FIG. 1, provided with the meandering-movement correction device 5 at the preceding stage of the heating device 7 thus correcting always the meandering movement of the steel strip 16 by the meandering-movement correction device 5. As a result, the meandering movement of the steel strip 16 on the entrance side of the heating device 7 is prevented thus overcoming the problem such as the steel-sheet fracture mentioned above.

On the other hand, when the above-mentioned steel strip 16 is cold-rolled by the cold rolling mill 9, there exists the case where a meandering movement occurs, depending on rolling conditions, in the steel strip 16 while being cold-rolled. For example, when the sheet thickness varies in a sheet-thickness profile in the sheet width direction of a hot-rolled steel sheet that is a base material of the steel strip 16 (a case where a sheet thickness on one end side in the sheet width direction is larger than that on the other end side in the sheet width direction, or the like), even when work rolls of the cold rolling mill 9 are parallel to the steel strip 16 at the pressing-down position, the rolling reduction of a large sheet thickness portion in the steel strip 16 becomes large and hence a meandering movement occurs in the steel strip 16 while being cold-rolled. Such a meandering movement of the steel strip 16 attributed to the cold rolling influences a successive steel strip part succeeding the steel strip 16 while being cold-rolled; that is, the steel strip 16 before being cold-rolled located on the entrance side of the cold rolling mill 9. To be more specific, the meandering movement of the steel strip 16 attributed to the cold rolling causes a meandering movement of the steel strip 16 heated by the heating device 7 located at the preceding stage of the cold rolling mill 9. Accordingly, the overlapping lengths La and Lb between the inductors 71*a* and 71*b* of the heating device 7 and the respective edge portions 16*a* and 16*b* of the steel strip 16 (refer to FIG. 3) are changed due to the meandering movement of the steel strip 16. As a result, the underheat or the abnormal local heating of the edge portions 16*a* and 16*b* of the steel strip 16 occurs, and consequently leads to the steel-sheet fracture of the steel strip 16 while being cold-rolled. Here, the meandering-movement correction device 5 mentioned above is a device that corrects a meandering movement of the steel strip 16 by the steering function of the bridle rolls 5*a* to 5*d*. The meandering movement of the steel strip 16 corrected by the meandering-movement correction device 5 is a meandering movement attributed to the shape of a base material of the steel strip 16, and is different in occurrence cause from the meandering movement of the steel strip 16 that occurs in the cold rolling mill 9. Therefore, it is difficult to simultaneously and stably correct the meandering movement of the steel strip 16 while being transferred toward the heating device 7, and the meandering movement of the steel strip 16 attributed to the cold rolling by the meandering-movement correction device 5.

On the other hand, the cold rolling apparatus 1 according to the present embodiment is, as illustrated in FIG. 1, provided with the meandering-movement suppression device 8 between the heating device 7 and the cold rolling mill 9, and the meandering-movement suppression device 8 suppresses a meandering movement of the steel strip 16 attributed to the cold rolling. Accordingly, it is possible to eliminate the influence of the meandering movement of the steel strip 16 attributed to the cold rolling upon the steel strip 16 in the heating device 7. Thus, any change due to causes other than the change of the sheet width of the steel strip 16 will not be made on the overlapping lengths La and Lb in the heating device 7, which enables stable heating of both of the edge portions 16*a* and 16*b* of the steel strip 16 by the heating device 7. As a result, it is possible to overcome such problems as the steel-sheet fracture mentioned above.

Assuming that a device that corrects a meandering movement of the steel strip 16 with the steering function of the bridle rolls 5*a* to 5*d* (hereinafter, referred to as "steering mechanism") such as the meandering-movement correction device 5 mentioned above is arranged between the heating device 7 and the cold rolling mill 9 in place of the meandering-movement suppression device 8, a very large space for arrangement is required as compared with the meandering-movement suppression device 8. In addition, in order for the steering mechanism to sufficiently correct a meandering movement of the steel strip 16 by the steering of each roll body, it is necessary that a wrapping angle of the steel strip 16 for each roll body is made to be equal to or larger than a predetermined value (90 degrees or larger, for example). Thus, a temperature of the steel strip 16 after being heated by the heating device 7 (particularly, a temperature of each of the edge portions 16*a* and 16*b*) decreases due to natural cooling until the steel strip 16 is transferred from the heating device 7 to the cold rolling mill 9. The temperature of the steel strip 16 after being heated also decreases due to heat transfer along with the contact between the each roll body of the steering mechanism and the steel strip 16. In order to ensure that a temperature of the cold-rolled steel strip 16 is equal to or higher than a predetermined value (equal to or higher than a ductile brittle transition temperature), it is necessary that a temperature of the steel strip 16 heated by the heating device 7 is previously set higher in consideration of the above-mentioned temperature decrease. This processing has a problem in energy efficiency. On the other hand, the meandering-movement suppression device 8 according to the present embodiment causes, as illustrated in FIGS. 1 and 4, three roll bodies (the entrance side roll 8*a*, the exit side roll 8*b*, and the central roll 8*c*) arranged zigzag in the transfer direction of the steel strip 16 to sandwich the steel strip 16, so as to suppress a meandering movement of the steel strip 16. A space for arranging this meandering-movement suppression device 8 is very small as compared with the above-mentioned steering mechanism. Thus, a distance between the heating device 7 and the cold rolling mill 9 where the meandering-movement suppression device 8 is arranged can be shortened as much as possible. Furthermore, the meandering-movement suppression device 8 reduces the contact between the roll bodies and the steel strip 16 as compared with the above-mentioned steering mechanism so as to minimize the temperature decrease of the steel strip 16 attributed to heat transfer to the roll bodies. From the above, heating efficiency of the steel strip 16 by the heating device 7 can be improved and, at the same time, stable heating of the steel strip 16 by the heating device 7 can be achieved.

EXAMPLE

Next, an example of the present invention is explained. In the present example, the cold rolling apparatus 1 illustrated in FIG. 1 joined the distal end portion and the tail end portion of the respective steel sheets 15 with its content of silicon being 3.0% or more by using the welding machine 3 to form the steel strip 16, heated both of the edge portions 16*a* and 16*b* of the steel strip 16 by using the heating device 7, and continuously cold-rolled the steel strip 16 after being heated by using the cold rolling mill 9. In this case, the heating condition of the steel strip 16 by the heating device 7 was set so that both of the edge portions 16*a* and 16*b* of the steel strip 16 immediately before entering into the cold rolling mill 9 are surely heated to a temperature of 60° C. or higher. The cold rolling apparatus 1 also corrected a meandering movement of the steel strip 16 by using the steering function of the meandering-movement correction device 5 and, at the same time, restrained the movement of the steel strip 16 in the sheet width direction by pressing down the central roll 8*c* in the meandering-movement suppression device 8. The cold rolling apparatus 1 heated, while maintaining this state, both of the edge portions 16*a* and 16*b* of the steel strip 16 by using the heating device 7.

Furthermore, in comparative examples 1 and 2 with respect to the present example, the cold rolling apparatus 1 changed the setting conditions of the meandering-movement correction device 5, the heating device 7, and the meandering-movement suppression device 8, and cold-rolled the steel strip 16. To be more specific, in the comparative example 1, the cold rolling apparatus 1 enabled a meandering-movement correction function of the steel strip 16 by the meandering-movement correction device 5 mentioned above, but lifts up the central roll 8*c* in the meandering-movement suppression device 8 so as not to restrain the movement of the steel strip 16 in the sheet width direction. The cold rolling apparatus 1 heated, while maintaining this state, both of the edge portions 16*a* and 16*b* of the steel strip 16 by using the heating device 7. On the other hand, in the comparative example 2, the cold rolling apparatus 1 disabled both of the meandering-movement correction function of the steel strip 16 by the meandering-movement correction device 5 and the restraint function (meandering-movement suppression function) of the steel strip 16 by the meandering-movement suppression device 8 mentioned above. The cold rolling apparatus 1 heated, while maintaining this state, both of the edge portions 16*a* and 16*b* of the steel strip 16 by using the heating device 7. The other conditions in the comparative examples 1 and 2 were set identical with those in the present example.

In each of the present example and the comparative examples 1 and 2, the steel strips 16 of 500 coils were cold-rolled, and a fracture occurrence rate of the steel strip 16 cold-rolled was examined. The results of examinations are illustrated in Table 1.

TABLE 1

| | Fracture occurrence rate of steel strip (%) |
|---|---|
| Example | 0.2 |
| Comparative example 1 | 0.6 |
| Comparative example 2 | 1.2 |

As illustrated in Table 1, the fracture occurrence rate of the steel strip 16 in the present example was 0.2% that is a lower value as compared with the fracture occurrence rate (=0.6%) of the steel strip 16 in the comparative example 1 and the fracture occurrence rate (=1.2%) of the steel strip 16 in the comparative example 2. Particularly, the results of the examinations have indicated that the fracture occurrence rate of the steel strip 16 in the present example is decreased to one sixth that of the comparative example 2 in which the meandering-movement correction function of the steel strip 16 by the meandering-movement correction device 5, and the restraint function of the steel strip 16 by the meandering-movement suppression device 8 were disabled. This means that correcting a meandering movement of the steel strip 16 on the entrance side of the heating device 7 by the steering function of the meandering-movement correction device 5 and, at the same time, suppressing a meandering movement of the steel strip 16 attributed to the cold rolling on the exit side of the heating device 7 by the meandering-movement suppression device 8 results in the stationary control of the overlapping lengths La and Lb between the heating device 7 and the steel strip 16 thus ensuring that the temperature of each of the edge portions 16*a* and 16*b* of the steel strip 16 is equal to or higher than the ductile brittle transition temperature so as to cold-roll the steel strip 16. That is, a synergetic effect of the meandering-movement correction function of the steel strip 16 by the meandering-movement correction device 5 and the restraint function of the steel strip 16 by the meandering-movement suppression device 8 mentioned above is extremely effective in stationarily controlling the overlapping lengths La and Lb between the heating device 7 and the steel strip 16 so as to stably heat both of the edge portions 16*a* and 16*b* of the steel strip 16. Furthermore, the synergetic effect is extremely effective in preventing the underheat and the abnormal local heating of both of the edge portions 16*a* and 16*b* so as to reduce the occurrence of the steel-sheet fracture (fracture attributed to edge cracks, drawing fracture attributed to edge waves, or the like) when the steel strip 16 is cold-rolled.

As explained heretofore, in the embodiment of the present invention, the meandering-movement correction device that is arranged on the upstream side in the transfer direction of a steel strip than the heating device heating a sequentially transferred steel strip corrects a meandering movement of a steel strip transferred to the heating device, and the meandering-movement suppression device that is arranged between the cold rolling mill sequentially cold-rolling a steel strip after being heated and the heating device suppresses a meandering movement of a steel strip that is attributed to the cold rolling of the steel strip by the cold rolling mill.

Accordingly, it is possible to correct a meandering-movement amount of the steel strip on the entrance side of the heating device to a value within the allowable range with respect to the heating device and, at the same time, to eliminate the influence of a meandering movement of the steel strip attributed to the cold rolling upon the steel strip passing through the heating device. Thus, it is possible to maintain a state where a meandering movement of the steel strip has been corrected in the period of heating the steel strip by the heating device. As a result, it is possible to stationarily control the overlapping length between the heating device and the steel strip to an optimal value for the cold rolling of the steel strip and stably heat both of the edge portions of the steel strip to a temperature equal to or higher than the ductile brittle transition temperature. Accordingly, it is possible to suppress the occurrence of the steel-sheet fracture attributed to the underheat (edge crack) or the abnormal local heating (edge wave) of both of the edge portions of the steel strip as much as possible to achieve the stable cold rolling of the steel strip.

The cold rolling apparatus according to an embodiment of the present invention is used not only for a general steel sheet but also for any types of materials to be rolled, such as a silicon steel sheet that is a material difficult to be rolled, or a strip-shaped steel sheet (steel strip) having a joint portion between a precedence material and a succeeding material thus suppressing both the meandering movement of a material to be rolled that occurs due to the rapid change of the shape of the material to be rolled or the change of a roll crown. Since a meandering-movement suppression action of the material to be rolled is performed on the entrance side and the exit side of the heating device, the overlapping length of the material to be rolled in the heating device is stationarily controlled to an optimal value thus heating stably both the edge portions of the material to be rolled to a target temperature. As a result, it is possible to avoid both a situation in which a fracture occurs in the material to be rolled while being cold-rolled, due to the edge cracks attributed to the underheat of the edge portion, and a situation in which a drawing fracture occurs in the material to be rolled while being cold-rolled, due to the edge wave attributed to the abnormal local heating of the edge portion thus improving the operation efficiency and the production efficiency of the cold rolling.

Here, in the embodiment mentioned above, although the cold rolling apparatus constituted of the completely continuous cold tandem mill in which the steel sheets supplied from the coil are continuously cold-rolled and thereafter, wound in a coiled shape is exemplified, the present invention is not limited to this example.

The cold rolling apparatus according to the present invention may be an apparatus constituted of a tandem mill other than a completely continuous cold tandem mill, such as a continuous tandem mill arranged subsequently to a pickling line and a single-stand reverse mill.

Furthermore, in the embodiment mentioned above, although the cold rolling mill constituted of four rolling mills arranged next to each other in the transfer direction of the steel strip is used, the present invention is not limited to this example. That is, in the present invention, any number of rolling mills (any number of roll stands) in the cold rolling apparatus, and any number of roll stages may be applicable.

Furthermore, in the embodiment mentioned above, although the steel strip is exemplified as one example of the material to be rolled, the present invention is not limited to this example. The cold rolling apparatus according to the present invention are applicable to any of a general steel sheet, a strip-shaped steel sheet (steel strip) composed of a plurality of steel sheets joined to each other, and a material difficult to be rolled such as a silicon steel sheet. That is, in the present invention, any of a steel grade, a joint state, and a shape of the steel sheet as a material to be rolled may be applicable.

Furthermore, in the embodiment mentioned above, although the meandering-movement correction device provided with four bridle rolls is exemplified, the present invention is not limited to this example. The meandering-movement correction device of the cold rolling apparatus according to the present invention may be a device capable of correcting the meandering movement of the material to be rolled by the steering function of a roll body. In this case, the roll body of the meandering-movement correction device is not limited to the bridle roll, and may be a steering roll. In addition, the number of roll bodies arranged in the meandering-movement correction device is not limited to four, and a plurality of roll bodies may be applicable.

Furthermore, in the embodiment mentioned above, although the meandering-movement suppression device provided with three roll bodies is exemplified, the present invention is not limited to this example. In the meandering-movement suppression device according to the present invention, the number of roll bodies that are arranged zigzag in the transfer direction of a material to be rolled, sandwiching the material to be rolled is not limited to three, and a plurality of roll bodies may be applicable.

Furthermore, the present invention is not limited to the embodiment and the example that are mentioned above, and the present invention includes a case of constituting the above-mentioned respective constitutional features arbitrarily by combining with each other. In addition, various modifications, applications, or the like made by those skilled in the art based on the embodiment mentioned above are arbitrarily conceivable without departing from the gist of the present invention.

As mentioned above, the cold rolling apparatus according to the present invention are useful for the cold rolling of the steel sheet, and particularly suitable for suppressing the occurrence of steel-sheet fractures as much as possible, and cold-rolling a steel sheet stably.

REFERENCE SIGNS LIST

1 cold rolling apparatus
2 uncoiler
3 welding machine
4 looper
4*a*, 4*c*, 4*e*, 4*g* fixed roll
4*b*, 4*d*, 4*f* movable roll
5 meandering-movement correction device
5*a* to 5*d* bridle roll
5*e* roll tilting unit
6 sheet width meter

7 heating device
8 meandering-movement suppression device
8*a* entrance side roll
8*b* exit side roll
8*c* central roll
8*d* roll movement unit
9 cold rolling mill
9*a* to 9*d* rolling mill
10 flying shear
11 tension reel
12 controller
15 steel sheet
16 steel strip
16*a*, 16*b* edge portion
71*a*, 71*b* inductor
72*a*, 72*b*, 73*a*, 73*b* leg portion
74*a*, 74*b* heating coil
75*a*, 75*b* carriage
76*a*, 76*b* position controller
77 matching board
78 high frequency power supply
79 calculation unit
C1, C2 roll center axis

The invention claimed is:

1. The A cold rolling apparatus comprising:

a heating device configured to heat a sequentially transferred steel sheet;

a cold rolling mill configured to sequentially cold-roll the steel sheet after being heated;

a meandering-movement correction device arranged on an upstream side of the heating device in a transfer direction of the steel sheet, and configured to correct a meandering movement of the steel sheet transferred toward the heating device, the meandering-movement correction device includes:

roll bodies configured to rotate while being brought into contact with the steel sheet so as to transfer the steel sheet; and a roll tilting unit configured to tilt the roll bodies so that a center axis of each of the roll bodies tilts with respect to a horizontal direction, and a meandering-movement suppression device arranged between the heating device and the cold rolling mill, and configured to suppress a meandering movement of the steel sheet attributed to the cold rolling of the steel sheet by using the cold rolling mill, the meandering-movement suppression device includes a plurality of roll bodies arranged zigzag in the transfer direction of the steel sheet and configured to transfer the steel sheet toward an entrance side of the cold rolling mill from an exit side of the heating device and to sandwich the steel sheet from both sides of the steel sheet in a thickness direction so as to restrain the movement thereof in a width direction.

2. The cold rolling apparatus according to claim 1, wherein the roll bodies in the meandering-movement correction device are bridle rolls configured to control a tensile force of the steel sheet.

3. The cold rolling apparatus according to claim 1, wherein the heating device includes C-shaped inductors into which respective edge portions of the steel sheet in a width direction are inserted in a sandwiched and spaced apart manner in a thickness direction of the steel sheet, and the heating device heats both of the edge portions of the steel sheet by an induction heating system.

4. The cold rolling apparatus according to claim 1, wherein the heating device includes C-shaped inductors into which respective edge portions of the steel sheet in a width direction are inserted in a sandwiched and spaced apart manner in a thickness direction of the steel sheet, and the heating device heats both of the edge portions of the steel sheet by an induction heating system.

5. The cold rolling apparatus according to claim 2, wherein the heating device includes C-shaped inductors into which respective edge portions of the steel sheet in a width direction are inserted in a sandwiched and spaced apart manner in a thickness direction of the steel sheet, and the heating device heats both of the edge portions of the steel sheet by an induction heating system.

6. The cold rolling apparatus according to claim 1, further comprising a controller, the controller configured to:

control the meandering-movement correction device to perform a meandering movement correction operation to correct the meandering movement of the steel sheet transferred toward the heating device; and control the meandering-movement suppression device to perform a meandering-movement suppression operation to suppress the meandering movement of the steel sheet attributed to the cold rolling of the steel sheet, wherein the controller controls the meandering-movement suppression device to perform the meandering-movement suppression operation at a timing when the controller controls the meandering-movement correction device to perform the meandering-movement correction operation.

* * * * *